US007662027B2

(12) United States Patent
Hutchins

(10) Patent No.: US 7,662,027 B2
(45) Date of Patent: Feb. 16, 2010

(54) ROTOR WITH WEAR-RESISTANT CORE FOR A POWER ABRADING OR POLISHING TOOL

(75) Inventor: Donald H. Hutchins, Sierra Madre, CA (US)

(73) Assignee: Hutchins Manufacturing Company, Pasadena, CA (US)

( * ) Notice: Subject to any disclaimer, the term of this patent is extended or adjusted under 35 U.S.C. 154(b) by 0 days.

(21) Appl. No.: 11/862,190

(22) Filed: Sep. 26, 2007

(65) Prior Publication Data

US 2008/0076337 A1 Mar. 27, 2008

Related U.S. Application Data

(60) Provisional application No. 60/827,039, filed on Sep. 26, 2006.

(51) Int. Cl.
*B24B 27/08* (2006.01)

(52) U.S. Cl. ..... 451/344; 418/152; 418/179; 451/354; 451/358; 451/359

(58) Field of Classification Search ..... 418/152, 418/179, 259, 268; 451/344, 354, 356, 357, 451/358, 359

See application file for complete search history.

(56) References Cited

U.S. PATENT DOCUMENTS

| | | | | |
|---|---|---|---|---|
| 1,143,725 | A | | 6/1915 | Reed |
| 3,283,352 | A | | 11/1966 | Hu |
| 4,058,936 | A | | 11/1977 | Marton |
| 4,434,587 | A | | 3/1984 | McDougall |
| 4,592,170 | A | | 6/1986 | Hutchins et al. |
| 4,660,329 | A | | 4/1987 | Hutchins |
| 4,671,019 | A | | 6/1987 | Hutchins |
| 4,839,995 | A | | 6/1989 | Hutchins |
| 4,854,085 | A | | 8/1989 | Huber |
| 4,924,633 | A | | 5/1990 | Hock et al. |
| 4,924,636 | A | | 5/1990 | Hoffman |
| 4,986,036 | A | | 1/1991 | Hutchins |
| 5,165,881 | A | * | 11/1992 | Wicen ..... 418/152 |
| 5,253,990 | A | | 10/1993 | Hutchins |
| 5,319,888 | A | | 6/1994 | Huber et al. |
| 5,347,673 | A | | 9/1994 | Nickels, Jr. |
| 5,392,568 | A | | 2/1995 | Howard, Jr. et al. |
| 5,411,386 | A | | 5/1995 | Huber et al. |
| 5,445,558 | A | | 8/1995 | Hutchins |
| 5,464,366 | A | | 11/1995 | Hutchins |
| 5,518,441 | A | | 5/1996 | Valentini |
| 5,580,302 | A | | 12/1996 | Howard, Jr. et al. |
| 5,582,541 | A | | 12/1996 | Hutchins |
| 5,595,530 | A | | 1/1997 | Heidelberger |
| 5,597,348 | A | | 1/1997 | Hutchins |
| 5,823,862 | A | | 10/1998 | Heidelberger |

(Continued)

*Primary Examiner*—Timothy V Eley
(74) *Attorney, Agent, or Firm*—Christie, Parker & Hale LLP.

(57) ABSTRACT

A power driven abrading or polishing tool is provided that includes a motor having a rotor; a carrier part having a shaft and a key extending from the shaft; and an abrading or polishing head attached to the carrier part. The rotor includes an outer body of a first material and a core of a second material having a resistance to wear greater than the first material. The core includes an inner passage with a keyway which receives the key on the shaft of the carrier part such that a rotation of the rotor is transmitted to the carrier part and the head.

24 Claims, 4 Drawing Sheets

U.S. PATENT DOCUMENTS 5,879,228 A * 3/1999 Sun ..... 451/357
6,007,412 A 12/1999 Hutchins
6,190,245 B1 2/2001 Heidelberger et al.
6,257,970 B1 * 7/2001 Huber ..... 451/357
6,485,360 B1 * 11/2002 Hutchins ..... 451/357
7,008,187 B2 * 3/2006 Cazzaniga ..... 416/132 R
2008/0160887 A1 * 7/2008 Hutchins ..... 451/357
2008/0160888 A1 * 7/2008 Hutchins ..... 451/359

* cited by examiner

FIG. 1
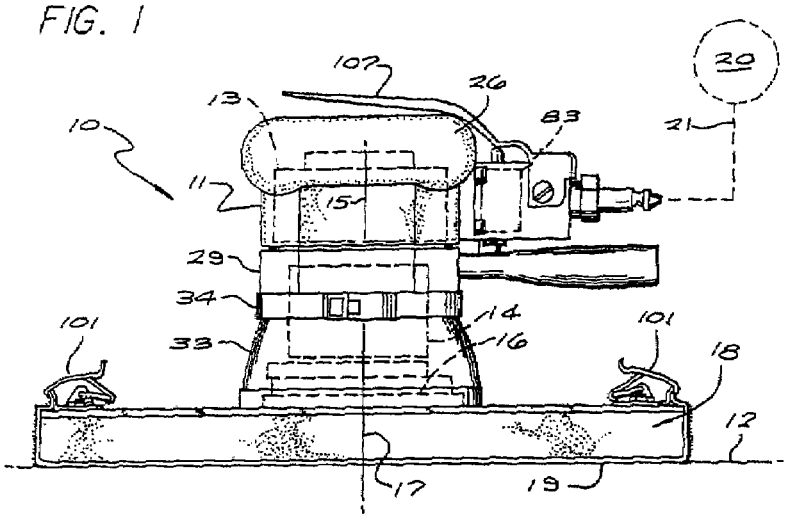
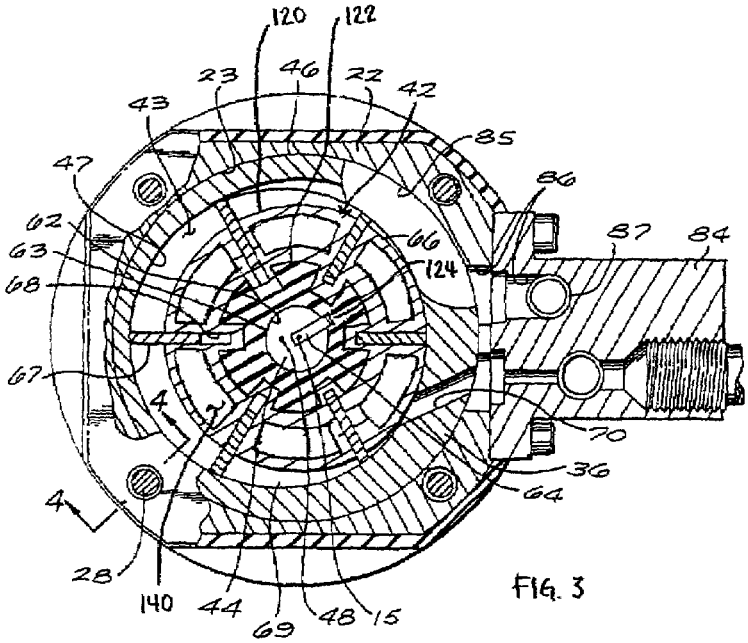
FIG. 3
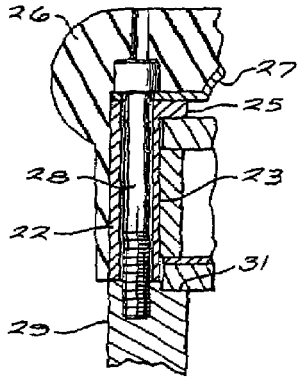
FIG. 4

ROTOR WITH WEAR-RESISTANT CORE FOR A POWER ABRADING OR POLISHING TOOL

CROSS-REFERENCE TO RELATED APPLICATION(S)

This application claims priority to and the benefit of U.S. Provisional Patent Application No. 60/827,039, filed on Sep. 26, 2006, the entire contents of which are incorporated herein by reference.

FIELD OF THE INVENTION

This invention relates generally to an improved rotor for a power abrading or polishing tool, such as an orbital abrading or polishing tool, and more particularly to such a rotor having a wear-resistant core.

BACKGROUND OF THE INVENTION

A known orbital abrading or polishing tool includes a motor having a rotor, which transmits a rotational force to a carrier part having an abrading or polishing head attached thereto. In this tool, a key extends from the carrier part and engages a keyway in the rotor, such that rotation of the rotor causes a corresponding rotation of the carrier part and the abrading or polishing head.

The rotors of such tools are typically made of steel or other suitable wear-resistant metals, although plastic or resinous materials have also been used. When a rotor is made of plastic or resinous materials, however, the keyway formed in the rotor wears easily. As such, the rotor must be replaced relatively frequently. Accordingly, a need exists for an improved rotor for an orbital abrading or polishing tool.

SUMMARY OF THE INVENTION

In one embodiment, the present invention is a power driven abrading or polishing tool that includes a motor having a rotor; a carrier part having a shaft and a key extending from the shaft; and an abrading or polishing head attached to the carrier part. The rotor includes an outer body composed of a first material, which may be a metal of relatively low wear resistance, such as aluminum, or a synthetic polymeric material such as that commonly referred to as "plastic," and further includes a wear resistant core having a resistance to wear greater than that of the outer body. The core includes an inner passage with a keyway that receives the key on the shaft of the carrier part such that rotation of the rotor is transmitted to the carrier part and the head.

In another embodiment, the present invention is a power driven orbital abrading or polishing tool that includes a motor comprising a rotor; a carrier part having a shaft and a key extending from the shaft; and an abrading or polishing head attached to the carrier part. The rotor includes a core composed of a wear-resistant metallic material and having an inner passage with a keyway that receives the key on the shaft of the carrier part such that rotation of the rotor is transmitted to the carrier part and the head. The rotor also includes a generally cylindrically shaped outer body disposed in surrounding relation to the core and comprising material of relatively low wear resistance, such as aluminum or a synthetic polymeric material.

Other features and advantages of the present invention will become apparent from the following detailed description, taken in conjunction with the accompanying drawings which illustrate, by way of example, the features of the present invention.

BRIEF DESCRIPTION OF THE DRAWINGS

FIG. 1 is a side elevational view of a sander according to an exemplary embodiment of the invention;

FIG. 3 is a horizontal section taken primarily on line 3-3 of FIG. 2;

FIG. 4 is a fragmentary vertical section taken on line 4-4 of FIG. 3;

DETAILED DESCRIPTION OF THE DRAWINGS

Figure 2:
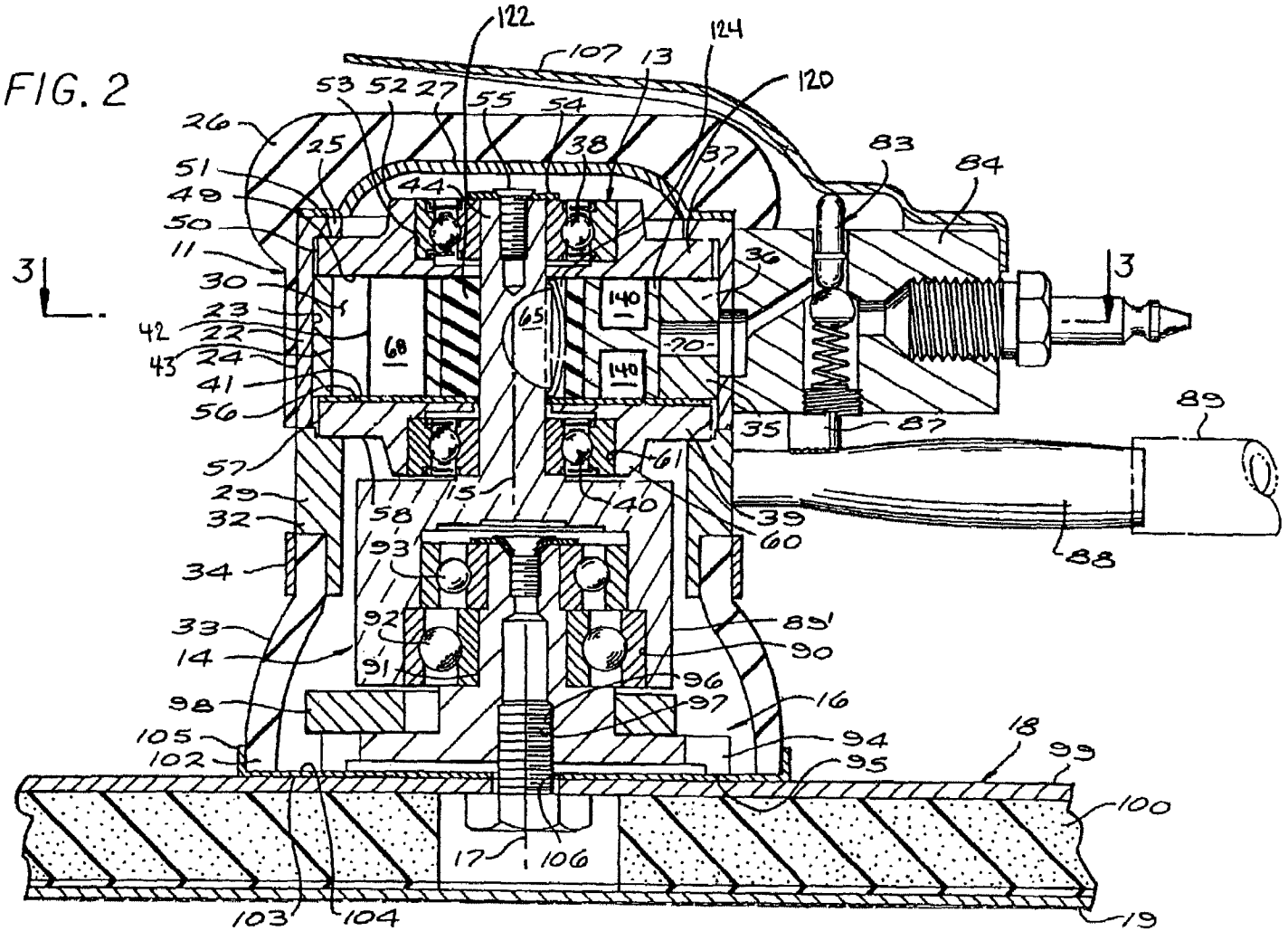
FIG. 2 is an enlarged central vertical section through the sander of FIG. 1.

As shown in FIGS. 1-6, embodiments of the present invention are directed to a power abrading or polishing tool, such as an orbital abrading or polishing tool including a motor having a rotor, which transmits a rotational force to a carrier part having an abrading or polishing head attached thereto. A key extends from the carrier part and engages a keyway in the rotor such that a rotation of the rotor causes a corresponding rotation of the carrier part and the abrading or polishing head. In one embodiment, the keyway is disposed in a wear-resistant metal core of the rotor such that wear of the keyway is reduced. The rotor may be made of a metallic material of relatively low wear resistance, such as aluminum, or a suitable synthetic polymeric material.

As shown in FIG. 1, the orbital tool 10 shown in the drawings has a body structure 11 shaped externally as a handle to be grasped by a user for holding the tool and moving it along a typically horizontal work surface 12 to sand or polish that surface. An air driven motor 13 contained within the body structure 11 drives a carrier part 14 rotatively about a vertical axis 15, with a part 16 being connected to carrier 14 for rotation relative thereto about a second vertical axis 17, in a relation driving an abrading head or shoe 18 and a carried sheet of sandpaper 19 orbitally about the axis 15 to the sand surface 12. Air is supplied to the motor 13 from a source 20 (shown schematically) of compressed air through a line 21 connecting into the rear of body structure 11.

As shown in FIGS. 2 and 4, the body structure 11 may be formed as an assembly of parts including a rigid main body part 22 having an internal surface 23 defining a recess within which the motor 13 is received. The part 22 may be metallic and may have an outer surface 24 of square horizontal section and an annular horizontal flange 25 at its upper end for confining the motor against upward removal from the body. A square cushioning element 26 may be carried about the body part 22 and extend across its upper side, and may be formed of an appropriate rubber, to function as a cushioned handle element by which the device is held in use. A rigid reinforcing element 27 is bonded to the undersurface of the top horizontal portion of the handle cushion 26, and with the attached part 26 is secured to the body 22 by four screws 28 (see FIG. 4) extending downwardly through vertically aligned openings or passages in the parts 22 and 27, with the heads of the screws engaging downwardly against the part 27, and with the lower ends of the screws being connected threadedly to a retainer 29 which is tightenable upwardly against the motor to retain it in the recess 30 formed within the body structure. The radially inner portion of the retainer 29 forms an upwardly facing annular horizontal shoulder surface 31 (see FIG. 4) which projects radially inwardly beyond the surface 23 to block downward withdrawal of the motor. The lower portion of the retainer 29 forms a tubular circular skirt 32 to which the upper end of a tubular rubber boot 33 is secured by an annular clamp 34.

The air motor 13 has a sectionally formed stator or housing 35 (see FIGS. 2 and 5) including a vertically extending side wall 36, a top wall 37 carrying a bearing 38 and a bottom wall 39 carrying a second bearing 40. A horizontal circular plate 41 is located above the bottom wall 39. The rotor 42 of the motor is contained and driven rotatively within the motor chamber 43 formed by the housing parts, and is connected to an upper shaft portion 44 of the carrier 14, to drive that carrier rotatively about axis 15.

As shown in FIG. 3, the side wall 36 of the motor housing has an external cylindrical surface 46 which fits closely within and engages internal cylindrical surface 23 of the body 22 to be located thereby. Internally, the side wall 36 has a vertical surface 47 which may be cylindrical but eccentric with respect to axis 15, and more particularly may be centered about a vertical axis 48 which is parallel to but offset from the axis 15 to give the desired eccentricity to the surface 47.

The top wall 37 has a planar horizontal undersurface 49 forming the top of chamber 43 within which the rotor 42 is received. The top wall 37 has an outer edge surface 50 which is received closely adjacent the internal surface 23 of the part 22. At its upper side, the top wall 37 has an annular surface 51 which is engaged by the annular flange 25 of the body part 22 to clamp the top wall 37 downwardly against the side wall 36 of the motor. Radially inwardly of the surface 51, the top wall 37 has an annular portion 52 defining a cylindrical recess 53 within which the outer race of the ball bearing 38 is received and located. The externally cylindrical vertical shaft portion 44 of the carrier 14 is a close fit within the inner race of the bearing 38, and is retained against downward withdrawal from the bearing 38 by a washer 54 secured to the shaft 44 by a screw 55 connected into the upper end of the shaft. The washer projects radially outwardly far enough to engage the upper surface of the inner race of the bearing 38 to maintain the parts in assembled condition.

The bottom wall 39 of the motor housing or stator is similar to the top wall 37, but inverted with respect to the top wall. More particularly, the bottom wall 39 has an upper planar horizontal surface 56, a cylindrical outer edge surface 57 which fits fairly closely within the cylindrical surface 23 of the body part 22, and a horizontal annular undersurface 58 which is engaged annularly by the shoulder surface 31 of the retainer 29 to clamp the bottom wall 39 upwardly against the side wall 36 of the motor housing. Radially inwardly of the surface 58, the bottom wall 39 has a downwardly projecting annular portion 60 defining an essentially cylindrical recess 61 within which the bottom ball bearing assembly 40 is received and located. The inner race of the bearing 40 is a close fit about the externally cylindrical shaft portion 44 of the carrier 14, to coact with the upper bearing 38 in the mounting part 14 for its desired rotation about the axis 15.

Figure 5:
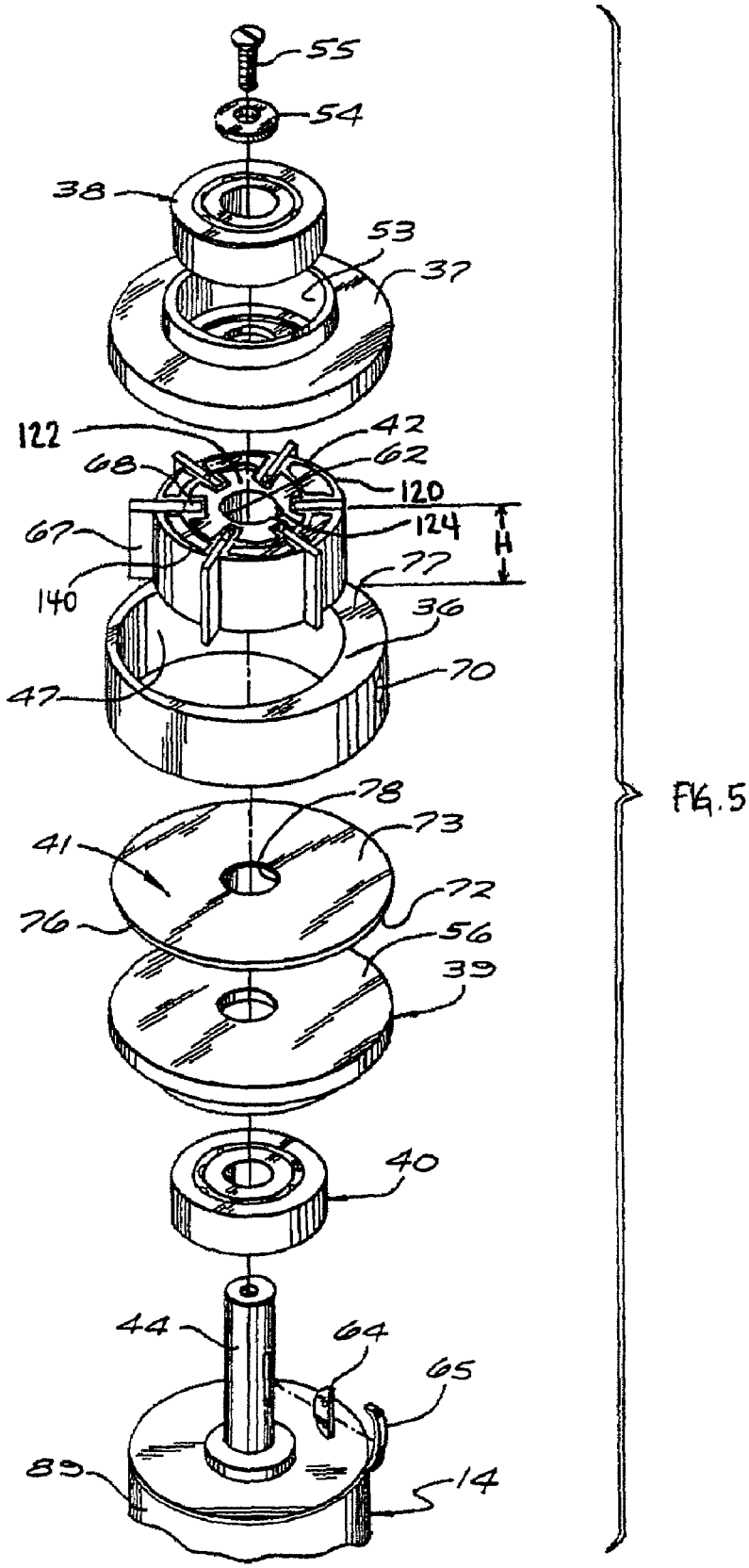
FIG. 5 is an exploded perspective view of various components of an air motor of the sander of FIG. 1.

As shown in FIG. 5, the rotor 42 of the motor has an inner cylindrical passage 62 that fits closely about the external cylindrical surface 63 of the shaft portion 44 of the carrier part 14. A key 64 received within opposed axially extending grooves in parts 44 and 42 transmits rotary motion from the rotor 42 to the shaft 44. A leaf spring 65 interposed radially between the rotor and key may exert radial force in opposite directions against these parts to take up any slight looseness which may occur.

Externally, the rotor 42 has a vertical cylindrical surface 66 centered about the axis 15 and therefore eccentric with respect to the motor housing surface 47 as seen in FIG. 3. A series of vanes 67 received slidably within radial slots 68 in the rotor are engageable with the surface 47 of the motor housing to form a series of air compartments 69 circularly between the vanes, which compartments vary progressively in size as the rotor turns so that the introduction of air into these compartments through an inlet passage 70 in the side wall 36 of the motor causes rotation of the rotor in a clockwise direction as viewed in FIG. 3, and hence a corresponding rotation of the carrier part 14 and the head 18.

Figure 6:
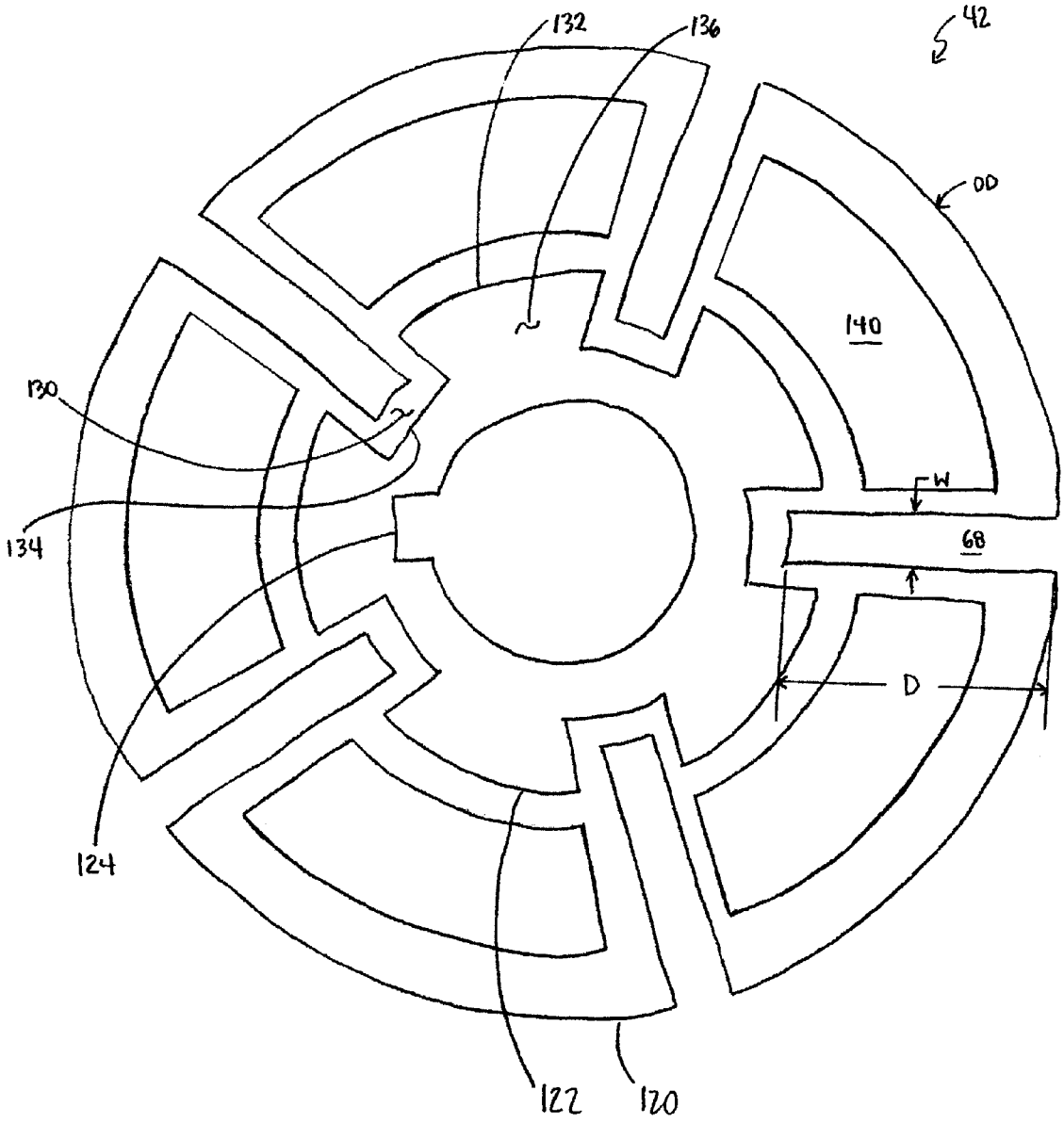
FIG. 6 is top view of a rotor according to an exemplary embodiment of the invention.

As shown in FIGS. 5 and 6, the rotor 42 includes a generally cylindrically-shaped outer body 120 that surrounds a central core 122. The outer body 120 is composed of a first material and the core 122 is composed of a second material having a greater resistance to wear than the first material. In one embodiment, the core 122 may be made of or comprise a suitable metallic material, such as steel or a composite containing metallic powder, and has a high resistance to wear. The outer body 120 may then be made of or comprise aluminum or other light metallic alloys or compositions, or any suitable polymeric material having sufficient strength and durability to withstand the rotational forces and wear to which the rotor 42 is subjected. The outer body 120 may also be moldable to form an integral body with the core 122. Materials for the outer body 120 include a variety of olefins, phenolics, acetals, polyamides (including 612 nylon or carbon fiber 46 nylon), or other suitable resinous materials. In a particular embodiment, a synthetic material used for the outer body 120 may be reinforced by any fibrous material suitable for use in a bearing structure. Such fibrous materials may include, for example, glass fiber, carbon fiber, or synthetic fibers such as aramid.

As shown in FIGS. 5 and 6, the radial slots 68, which receive the vanes 67 (described above), are disposed in the outer body 120 of the rotor 42, and the inner cylindrical passage 62 forms a through passage in the core 122. The inner cylindrical passage 62 includes a keyway 124 that receives the key 64 of the shaft 44 of the carrier part 14.

Preferably, the core 122 of the rotor 42 is non-rotatably coupled to the outer body 120 of the rotor 42, such that when compressed air flows against the vanes 67 causing a rotation of the outer body 120 of the rotor 42 (described below), the core 122 correspondingly rotates, which in turn causes a rotation of the carrier part 14 via the interaction of the keyway 124 of the core 122 and the key 64 of the shaft 44 of the carrier part 14.

In one embodiment, as shown in FIG. 6, in order to prevent a relative rotation between the outer body 120 and the core 122, an inner surface of the outer body 120 includes an alternating series of protrusions 130 and recesses 132, and the outer surface of the core 122 includes a corresponding alternating series of protrusions 136 and recesses 134. Each protrusion 130 on the inner surface of the outer body 120 mates with a corresponding one of the recesses 134 in the outer surface of the core 122, and each protrusion 136 on the outer surface of the core 122 mates with a corresponding one of the recesses 132 in the inner surface of the outer body 120. This causes the core 122 and the outer body 120 to interlock securely with one another to prevent rotation between them. In one embodiment, the rotor 42 is formed by molding, casting or otherwise forming the outer body 120 onto the core 122. One such process is the injection molding of the outer body 120 onto the core 122. In such processes, the core 122 becomes an integral component with the outer body 120.

In one embodiment, as shown in FIG. 6, each radial slot 68 is aligned with and extends into a corresponding one of the protrusions 130 on the inner surface of the outer body 120. This maximizes the depth D to which each radial slot 68 may extend. In addition, in this embodiment, each protrusion 136 on the outer surface of the core 122 extends between adjacent ones of the radial slots 68. This arrangement reduces the likelihood of the rotor 42 fracturing in use at one of the radial slots 68. Because the known non-metallic rotor (described above) does not include the described reinforcing metal core 122 of greater wear resistance, the radial slots in the known rotor cannot be made to the same depth as those of the present rotor 42 without risk of fracture. This is significant because the stability of a vane is directly related to the proportion of the vane contained within the slot.

In one embodiment, the outside diameter (OD) of the rotor 42 is approximately 1.35 inches, the depth (D) of each radial slot 68 is approximately 0.415 inches, and the width (W) of each radial slot 68 is approximately 0.070 inches. As such, each radial slot 68 is formed to a depth that is approximately 30% of the outer diameter (OD) of the rotor 42.

As is also shown in FIG. 6, a cavity 140 may be disposed between each radial slot 68 and adjacent to each protrusion 136 on the outer surface of the core 122. These cavities 140 extend into the rotor 42 from both its upper surface and its lower surface (see FIG. 2), terminating in a central web adjacent the core 122. As such, the cavities 140 reduce the overall mass of the rotor 42 without adversely affecting its torsional stability.

Viewing FIGS. 1-3 together, compressed air is delivered to chamber 43 of the motor from inlet 21 through a manually actuable valve 83 contained within a block 84 attached to body 22, and flows from the valve through passage 70 in side wall 36 into chamber 43. Air discharges from the chamber through a circularly elongated passage 85 formed in wall 36, and from that passage flows through passages 86 in parts 22 and 84 to a vertical tube 87 in the block 84, which tube delivers the exhaust downwardly into an exhaust tube 88 connecting with a discharge hose 89.

Beneath the level of the lower bearing 40, the carrier part 14 has an enlarged portion 89' which is typically externally cylindrical about the axis 15. The enlarged portion 89' then contains a recess 90 centered about the second axis 17 which is parallel to but offset laterally from the axis 15. The orbitally driven part 16 has an upper reduced diameter portion 91 projecting upwardly into the recess 90 and is centered about the axis 17 and journaled by two bearings 92 and 93 for rotation about the axis 17 relative to the carrier 14, so that as the carrier turns the part 16 is given an orbital motion. A lower enlarged diameter flange portion 94 of the part 16 has an annular horizontal undersurface 95 disposed transversely of the axis 17. A threaded bore 96 extends upwardly into the part 16 and is centered about the vertical axis 17, for engagement with an externally threaded screw 97 which detachably secures the head 18 to the rest of the device. A counterweight plate 98 may be located vertically between the carrier 14 and the flange 94 of the part 16, and be secured rigidly to the part 14 by appropriate fasteners. It may be externally non-circular about the axis 15 to counterbalance the eccentrically mounted part 16, the head 18, and any other connected elements.

The head 18 may be rectangular in horizontal section, including an upper horizontally rectangular rigid flat metal backing plate 99 having a rectangular resiliently deformable cushion 100 at its underside, typically formed of foam rubber or the like. The rectangular sheet of sandpaper 19 extends along the undersurface of the cushion 100, and then extends upwardly at opposite ends of the head for retention of its ends by two clips 101. The screw 97 extends upwardly through an opening in the plate 99 to secure the head 19 to the orbitally moving part 16.

The lower end 102 of the flexible tubular boot 33 carries and is permanently attached to a plate 103 preferably formed of sheet metal which is essentially rigid. Plate 103 has a horizontal circular portion 104 extending parallel to the upper surface of plate 99, and at its periphery has an upwardly turned cylindrical side wall portion 105 fitting closely about and bonded annularly to the lower externally cylindrical portion 102 of rubber boot 33. The plate 103 has a central opening 106 through which the screw 96 extends upwardly, so that upon tightening of the screw the plate 103 is rigidly clamped between the plate 99 and the element 16, with the boot 33 then functioning to retain the head 18 against rotation relative to the upper portion of the tool.

In operating the tool, a user holds the tool by grasping the upper handle portion 26, and then pressing downwardly on a lever 107 to open valve 83 and admit compressed air to the motor chamber. The air drives rotor 42 rotatively, with that rotation being transmitted to the upper reduced diameter shaft portion 44 of carrier 14. The rotation of the lower enlarged portion of carrier 14 causes orbital movement of the head 18 and its carried sandpaper sheet 19, to abrade the work surface 12. Because the rotor 42 has the core 122 with protrusions 136, the rotor 42 is light but extremely durable. The use of a metallic core avoids wear at the keyway 124, and the protrusions 136 permanently lock the polymeric outer body 120 of the rotor 42 to the core 122 of the rotor 42. The disclosed rotor 42 is therefore able to operate in its intended manner indefinitely.

Although the drawings illustrate the invention as applied to a power driven orbital sander, it will be apparent that the novel aspects of the air motor arrangement of the invention may also be utilized in other types of portable power driven abrading or polishing tools.

The preceding description has been presented with reference to various embodiments of the invention. Persons skilled in the art and technology to which this invention pertains will appreciate that alterations and changes in the described structures and methods of operation can be practiced without meaningfully departing from the principles, spirit and scope of this invention.

What is claimed is:

1. A power driven abrading or polishing tool comprising:

a motor having a rotor;

a carrier part having a shaft and a key extending from the shaft; and an abrading or polishing head attached to the carrier part;

wherein the rotor comprises an outer body comprised of a first material and a core of a second material having a resistance to wear greater than the first material, and wherein the core comprises an inner passage with a keyway which receives the key on the shaft of the carrier part such that a rotation of the rotor is transmitted to the carrier part and the head.

2. The tool of claim 1, wherein the core is metallic.

3. The tool of claim 2, wherein the core comprises steel.

4. The tool of claim 1, wherein the outer body of the rotor comprises a synthetic polymeric material.

5. The tool of claim 1, wherein the outer body comprises aluminum.

6. The tool of claim 1, wherein the outer body of the rotor is non-rotatably attached to the core of the rotor.

7. The tool of claim 6, wherein the outer body of the rotor is molded or cast onto the core of the rotor, such that an integral part is formed by the outer body and the core.

8. The tool of claim 7, wherein the outer body is injection molded onto the core.

9. The tool of claim 1, wherein the outer body of the rotor comprises a plurality of radial slots extending from an outer diameter of the rotor toward a center of the rotor, and wherein each radial slot receives a vane for transmitting rotary force to the rotor.

10. The tool of claim 9, wherein an inner surface of the outer body includes an alternating series of radial protrusions and recesses which mate with a complementary alternating series of radial recesses and protrusions on an outer surface of the core to non-rotatably couple the outer body to the core.

11. The tool of claim 10, wherein each radial slot is aligned with a corresponding one of the protrusions on the inner surface of the outer body of the rotor, such that an increased slot depth is achieved.

12. The tool of claim 11, wherein each protrusion on the outer surface of the core is disposed between adjacent ones of the radial slots to provide support to the radial slots.

13. The tool of claim 12, wherein the outer body comprises a cavity extending downwardly from an upper surface thereof and extending substantially between at least one adjacent pair of the radial slots.

14. The tool of claim 1, wherein the power driven abrading or polishing tool is a pneumatic orbital abrading or polishing tool.

15. A power driven orbital abrading or polishing tool comprising:

a motor having a rotor;

a carrier part having a shaft and a key extending from the shaft; and an abrading or polishing head attached to the carrier part;

wherein the rotor further comprises:

a metallic core and having an inner passage with a keyway that receives the key on the shaft of the carrier part such that a rotation of the rotor is transmitted to the carrier part and the head, and a generally cylindrically-shaped outer body disposed in surrounding relation to the core and comprised of a material having a resistance to wear lower than the metallic core.

16. The tool of claim 15, wherein the metallic core comprises steel.

17. The tool of claim 15, wherein the outer body of the rotor comprises a synthetic polymeric material.

18. The tool of claim 15 wherein the outer body comprises aluminum.

19. The tool of claim 15, wherein the outer body of the rotor is non-rotatably attached to the core of the rotor.

20. The tool of claim 19, wherein the outer body of the rotor is molded or cast onto the core of the rotor, such that an integral part is formed by the outer body and the core.

21. The tool of claim 16, wherein the outer body of the rotor comprises a plurality of radial slots extending from an outer diameter of the rotor toward a center of the rotor, and wherein each radial slot receives a vane which is acted upon by a force from a stream of compressed air to rotate the rotor.

22. The tool of claim 21, wherein an inner surface of the outer body includes an alternating series of radial protrusions and recesses, which mate with a complementary alternating series of radial recesses and protrusions on an outer surface of the core to non-rotatably couple the outer body to the core.

23. The tool of claim 22, wherein each radial slot is aligned with a corresponding one of the protrusions on the inner surface of the outer body of the rotor, such that that an increased slot depth is achieved.

24. The tool of claim 23, wherein each protrusion on the outer surface of the core is disposed between adjacent ones of the radial slots to provide support to the radial slots.

* * * * *